299-13 SR
10/14/80 XR 4,227,574

United States Patent [19]
Cha
[11] 4,227,574
[45] Oct. 14, 1980

[54] LOCATING THE TOP OF AN IN SITU OIL SHALE RETORT FOR EASE OF IGNITION

[75] Inventor: Chang Y. Cha, Bakersfield, Calif.

[73] Assignee: Occidental Oil Shale, Inc., Grand Junction, Colo.

[21] Appl. No.: 1,605

[22] Filed: Jan. 8, 1979

[51] Int. Cl.[2] ..... E21B 43/24; E21B 43/26
[52] U.S. Cl. ..... 166/259; 299/2; 299/13
[58] Field of Search ..... 166/259, 251, 247, 256, 166/271, 299; 299/2, 4, 13

[56] References Cited

U.S. PATENT DOCUMENTS

| | | | |
|---|---|---|---|
| 3,349,848 | 10/1967 | Burgh | 166/259 |
| 3,465,819 | 9/1969 | Dixon | 166/247 |
| 3,618,663 | 11/1971 | Needham | 166/247 |
| 3,620,301 | 11/1971 | Nichols et al. | 166/251 |
| 3,952,801 | 4/1976 | Burton | 166/256 |
| 4,027,917 | 6/1977 | Bartel et al. | 299/2 |
| 4,043,596 | 8/1977 | Ridley | 299/2 |
| 4,043,598 | 8/1977 | French et al. | 299/2 |
| 4,147,389 | 4/1979 | Bartel et al. | 299/2 |
| 4,149,595 | 4/1979 | Cha | 166/259 |

*Primary Examiner*—Stephen J. Novosad
*Attorney, Agent, or Firm*—Christie, Parker & Hale

[57] ABSTRACT

A method is disclosed for recovering liquid and gaseous products from an in situ oil shale retort having a plurality of strata of formation extending through the retort site with at least one stratum of formation having a higher average kerogen content than the average kerogen content of the formation within the retort site. The method includes the steps of excavating at least one void within the retort site and explosively expanding unfragmented formation toward such a void for forming a fragmented permeable mass of formation particles containing oil shale. The fragmented mass has a lower portion and an upper layer containing fragmented particles substantially from the stratum of formation having a higher average kerogen content. The upper layer of the fragmented mass has a higher average kerogen content than the average kerogen content of the fragmented mass. The upper layer is ignited for establishing a combustion zone in the fragmented mass. A combustion zone feed is introduced to the top of the fragmented mass and an off gas is withdrawn from the bottom of the fragmented mass for maintaining and advancing the combustion zone and for forming a retorting zone on the advancing side of the combustion zone. Oil Shale is retorted in the retorting zone producing liquid and gaseous products. The liquid and gaseous products produced are recovered from the fragmented mass.

9 Claims, 2 Drawing Figures

36
28
18
20
26
14
12
22
24
10
16
40

36
34
18
20
32
30
14
12
40
10
16

LOCATING THE TOP OF AN IN SITU OIL SHALE RETORT FOR EASE OF IGNITION

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is, in fact, a misnomer; it is neither shale nor does it contain oil. It is a sedimentary formation comprising marlstone deposit having layers containing an organic polymer called "kerogen," which upon heating decomposes to produce hydrocarbonaceous liquid and gaseous products. It is the formation containing kerogen that is called "oil shale" herein, and the hydrocarbonaceous liquid product is called "shale oil."

The average kerogen content of formation containing oil shale can be determined by a standard "Fischer assay" in which a sample of core customarily weighing 100 grams and representing one foot of core drilled from the formation is subjected to controlled laboratory analysis involving grinding the sample into small particles which are placed in a steel vessel and subjected to heat at a known rate of temperature rise to measure the kerogen content of the core sample. Kerogen content is usually stated in units of "gallons per ton," referring to the number of gallons of shale oil recoverable from a ton of oil shale heated in the same manner as in the Fischer analysis. The average kerogen content of formation containing oil shale varies over a broad range from essentially barren shale having no kerogen content up to a kerogen content of about 70 gallons per ton. Localized regions can have even higher kerogen contents, but these are not common. It is often considered uneconomical to retort formation containing oil shale having an average kerogen content of less than about eight to ten gallons per ton.

Formation containing oil shale can be hundreds of feet thick. Often there are strata of substantial thickness within such formation having significantly different kerogen contents than other strata in the same formation. Thus, for example, in one formation containing oil shale in Colorado that is a few hundred feet thick, the average kerogen content is on the order of about 17 gallons per ton. Within this formation there are strata ten feet or so thick in which the kerogen content is in excess of 30 gallons per ton. In another portion of this same formation there is a stratum almost 30 feet thick having nearly zero kerogen content. Similar stratification of kerogen content occurs in many formations containing oil shale.

The recovery of liquid and gaseous products from oil shale deposits has been described in several patents, such as U.S. Pat. Nos. 3,661,423; 4,043,595; 4,043,596; 4,043,597; and 4,043,598 which are incorporated herein by this reference. Such patents describe in situ recovery of liquid and gaseous materials from a subterranean formation containing oil shale by mining out a portion of the subterranean formation and then fragmenting a portion of the remaining formation to form a stationary, fragmented permeable mass of formation particles containing oil shale, referred to herein as an in situ oil shale retort. Retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of an oxygen-containing retort inlet mixture into the retort as a gaseous combustion zone feed to advance the combustion zone through the retort. In the combustion zone, oxygen in the combustion zone feed is depleted by reaction with hot carbonaceous materials to produce heat and combustion gas. By the continued introduction of the gaseous combustion zone feed into the combustion zone, the combustion zone is advanced through the retort.

The effluent gas from the combustion zone comprises combustion gas and any gaseous portion of the combustion zone feed that does not take part in the combustion process. This effluent gas passes through the fragmented mass in the retort on the advancing side of the combustion zone to heat oil shale in a retorting zone to a temperature sufficient to produce kerogen decomposition, called retorting, in the oil shale to gaseous and liquid products and to a residue of solid carbonaceous material.

The liquid products and gaseous products are cooled by cooler particles in the fragmented mass on the advancing side of the retorting zone. The liquid products, together with water produced in or added to the retort, are collected at the bottom of the retort and withdrawn to the surface through an access tunnel, drift, or shaft. An off gas containing combustion gas generated in the combustion zone, gaseous products produced in the retorting zone, gas from carbonate decomposition, and any gaseous portion of the combustion zone feed that does not take part in the combustion zone process is also withdrawn to the surface.

Establishment of a combustion zone in the retort can be effected according to methods described in U.S. Pat. No. 4,027,917; U.S. Pat. No. 3,952,801; and U.S. patent application Ser. No. 810,491, filed on June 27, 1977, now U.S. Pat. No. 4,147,389, issued Apr. 3, 1979, which is assigned to the same assignee as the present application, all of which are incorporated herein by this reference.

U.S. Pat. No. 3,952,801 describes a technique for establishing a combustion zone in a retort by igniting the top of a fragmented permeable mass in the retort. According to this technique, a hole is bored to the top of the fragmented permeable mass and a burner is lowered through the bore hole to the oil shale to be ignited. A mixture of combustible fuel such as LPG (liquefied petroleum gas) and gas-containing oxygen, such as air, is burned in the burner and the resultant flame is directed downwardly toward the fragmented permeable mass. The burning is conducted until a substantial portion of the oil shale has been heated above its ignition temperature so combustion of oil shale in the fragmented mass is self-sustaining. Following ignition, introduction of fuel is terminated, the burner is withdrawn from the retort through the hole, and oxygen-supplying gas is introduced to the retort to advance the combustion zone through the retort.

U.S. Pat. No. 4,147,389 discloses a method for igniting and forming a combustion zone within the fragmented permeable mass of formation particles in an in situ oil shale retort. The method disclosed therein teaches forming a void above the upper boundary of the fragmented mass and placing in that void a combustible material such as particulate coal. The particulate combustible material placed in the void is more easily combustible than the fragmented permeable mass of formation particles containing oil shale. The combustible material is ignited by a burner lowered to the void for igniting such combustible material. Following ignition of the combustible material the operation of the burner is ceased. The heat generated from the combustion of the combustible material is utilized for forming a combustion zone within the fragmented mass of formation particles containing oil shale.

It can be time consuming to establish a combustion zone in a retort. For example, a start-up time as long as a week has been experienced with a retort in the south-/southwest portion of the Piceance Creek structural basin in Colorado. Such a long start-up time results in consumption of large quantities of shale oil, LPG, or other processed fuel.

An in situ oil shale retort can have a substantial lateral extent. For example, it can be square with a lateral dimension of 160 feet or more. With such a large retort, a large number of burners and bore holes to various portions of the top of the retort and large quantities of fuel can be required for establishing a combustion zone in the retort. Preparation of a large number of bore holes and use of a large number of burners and large quantities of fuel can contribute significantly to the cost of producing liquid and gaseous products from oil shale.

It is desirable to maintain a combustion zone which is flat and uniformly transverse to the direction of advancement to maximize yield of products from the oil shale in an in situ oil shale retort. If the combustion zone is skewed relative to its direction of advancement, there is more tendency for oxygen present in the combustion zone to migrate into the retorting zone, thereby oxidizing products produced in the retorting zone and reducing the hydrocarbonaceous product yield in the liquid and gaseous products. In addition, excessive cracking of the hydrocarbonaceous products produced in the retorting zone can occur with a skewed and/or warped combustion zone. A combustion zone which is skewed and/or warped can be established if only a few burners are used for establishing the combustion zone. Use of more than a few burners to avoid a skewed or warped combustion zone can significantly increase the cost of establishing a combustion zone in a retort and producing shale oil.

Around each ignition point, or situs, in the fragmented permeable mass, a combustion zone is formed which tends to progress downwardly and laterally through the fragmented perameable mass. The combustion zone advances downwardly through the fragmented mass primarily resultant from convection of the hot gas flow through the retort and advances laterally and radially in the fragmented mass primarily by conduction and radiation. Since heat transfer by conduction and radiation through a fragmented mass of formation particles is much slower than heat transfer by convection, a substantial amount of unretorted oil shale can be left in the "corners" or side edges adjacent the walls of a retort. This can significantly reduce the yield of liquid and gaseous products obtained from the retort.

Thus it is desirable to provide a low cost and fast method for establishing a combustion zone in an in situ oil shale retort where the combustion zone is flat and uniformly transverse to its direction of advancement and extends laterally to the walls of the retort.

SUMMARY OF THE INVENTION

The present invention is directed to a method for recovering liquid and gaseous products from an in situ oil shale retort in a subterranean formation containing oil shale. In particular, the present method relates to a method for establishing a combustion zone in an in situ oil shale retort in a subterranean formation containing oil shale, the subterranean formation containing at least one stratum of formation having a higher average kerogen content than the average kerogen content of the formation within the retort site.

According to this method, a void is excavated in a subterranean formation containing oil shale within the boundaries of an in situ oil shale retort to be formed in the subterranean formation, the in situ oil shale retort to be formed having top, bottom and side boundaries. The remaining formation within the retort site, including at least one stratum of formation having a higher average kerogen content than the average kerogen content of formation with the retort site, is explosively expanded toward the void for forming a fragmented permeable mass of formation particles, the fragmented mass has an upper layer adjacent the top boundary containing fragmented particles substantially from such a stratum of formation having a higher average kerogen content than the average kerogen content of formation within the retort site, and a lower portion containing fragmented particles having a lower average kerogen content than the average kerogen content of the upper layer.

The upper layer forms an ignition situs for the fragmented mass and is ignited for establishing a combustion zone in the fragmented mass. The oil shale particles within the upper layer have a higher average heat of combustion than the average heat of combustion of the oil shale in the fragmented mass, and lateral spreading of the combustion zone is enhanced.

An oxygen-containing retort inlet mixture as a gaseous combustion zone feed is introduced to the upper layer of the fragmented mass for maintaining the combustion zone and for advancing the combustion zone downwardly through the fragmented mass. An off gas is withdrawn from the lower portion of the fragmented mass whereby gas flow on the advancing side of the combustion zone establishes a retorting zone in the fragmented mass and advances the retorting zone through the fragmented mass. The advancement of the retorting zone produces liquid and gaseous products from the fragmented mass. The gaseous products are withdrawn in the off gas and the liquid products are withdrawn from the lower portion of the fragmented mass.

BRIEF DESCRIPTION OF THE DRAWINGS

These and other features, aspects and advantages of the present invention will become more apparent when considered with respect to the following description, appended claims and accompanying drawings where:

DETAILED DESCRIPTION OF THE INVENTION

Figure 1:
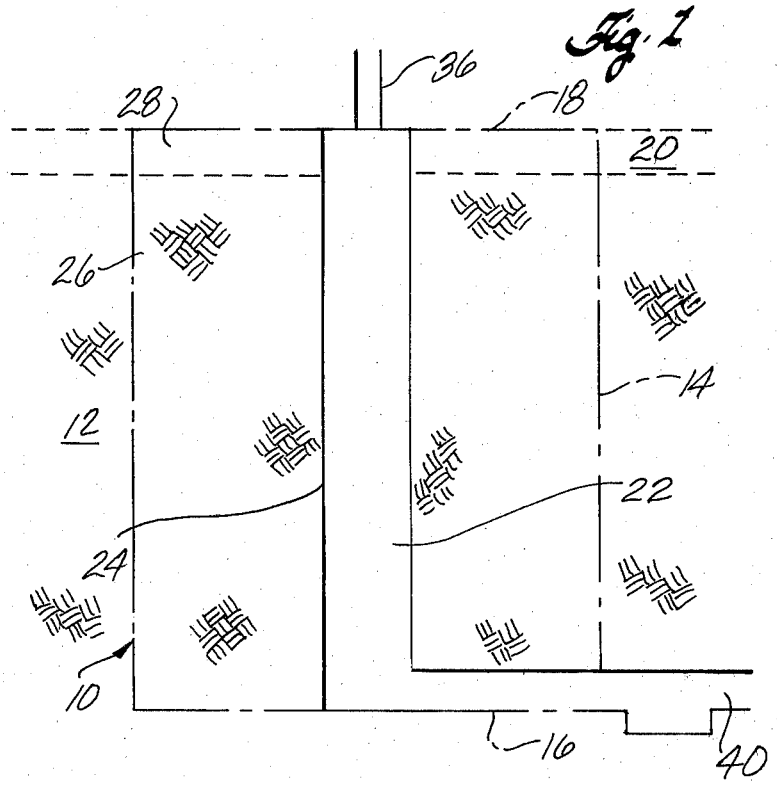
FIG. 1 shows a subterranean formation containing oil shale in an intermediate stage of preparation for in situ recovery of liquid and gaseous products.
Figure 2:
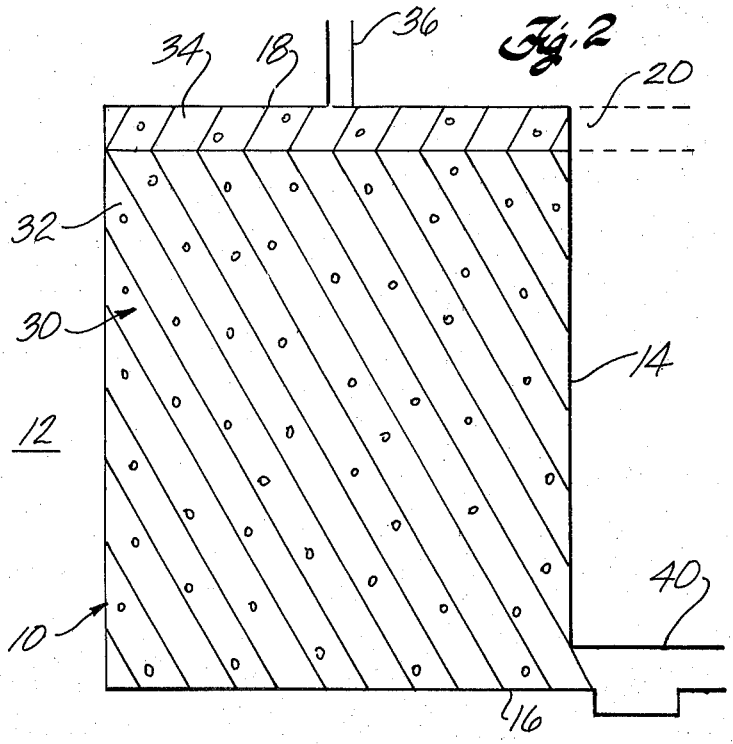
FIG. 2 illustrates schematically an in situ oil shale retort useful in the practice of this invention.

With reference to the drawings, an in situ oil shale retort 10 is formed in a subterranean formation 12 containing oil shale. The in situ oil shale retort shown in FIGS. 1 and 2 is rectangular in horizontal cross section, the retort being formed has a top or upper boundary 18, four vertically extending side boundaries 14 and a lower or bottom boundary 16. A drift 40 at a production level provides a means for access to the bottom boundary of the in situ retort. Formation which is excavated to form the drift 40 is transported to above ground through an adit or shaft (not shown).

FIGS. 1 and 2 schematically represent a stratum 20 of formation having an average kerogen content which is higher than the average kerogen content of formation within the boundaries of the in situ retort being formed. Thus, for example, the average kerogen content by Fischer Assay of the formation in the entire volume to become the in situ retort can be about 17 to 18 gallons per ton. The stratum 20 of relatively higher kerogen content can have a Fischer assay of over 30 gallons per ton. When the average kerogen content of the formation within the boundaries of the retort site is, for example, 30 gallons per ton, the stratum 20 adjacent the top boundary 18 can have a Fischer assay of over 40 gallons per ton. For purposes set out in greater detail below, the top boundary 18 of the retort being formed is located adjacent or within the stratum 20 of formation having the relatively higher kerogen content. The stratum 20 of higher kerogen content can be several feet thick and in the embodiment shown the stratum 20 extends in a generally horizontal plane through the formation 12, including through the retort site. Although one such stratum of higher kerogen content is illustrated in the figures, more than one such stratum can extend through the retort site, in which case the top boundary 18 of the fragmented mass being formed is still located adjacent such a stratum of relatively high kerogen content oil shale.

According to the embodiment shown in FIG. 1, the in situ retort is prepared by excavating a portion of the formation within the retort site to form a vertically extending columnar void or slot 22. A method for forming an in situ oil shale retort by excavating such a columnar void is disclosed in U.S. Pat. Nos. 4,043,595 and 4,043,596. The columnar void 22 can be cylindrical or can be a slot having large, parallel, or planar vertical free faces 24. This leaves a remaining portion of unfragmented formation 26 adjacent the void and within the boundaries of the retort site. Unfragmented formation defining the side walls 24 of the slot provides parallel free faces toward which the remaining unfragmented formation 26 within the boundaries of the retort site is explosively expanded to form a fragmented permeable mass of formation particles containing oil shale within the completed retort. The vertical slot 22 extends upwardly from the production level access drift 40 to the top boundary 18 of the retort being formed. The slot extends essentially the entire distance between a pair of the opposite parallel side walls 14 of the retort being formed. The slot 22 is located within the side boundaries of the retort so that the long dimension of the slot extends across the center of the horizontal cross section of the retort being formed. FIG. 1 illustrates the width, or narrow dimension, of the slot being located essentially in the center, between the boundaries 14 defining the sides of the retort being formed. In one embodiment of a retort about 120 feet square the slot is over 120 feet in length and about 24 feet wide. The slot is over 200 feet in height and provides a void fraction of about 20 percent in the fragmented permeable mass of formation particles formed within the completed retort.

The slot 22 is formed by initially drilling and boring a circular raise extending between the bottom boundary 16 and the top boundary 18 of the retort being formed. The raise is bored at the center of the slot being formed. Rows of blasting holes are drilled downwardly on opposite sides of the raise. The blasting holes extend from the top boundary 18 to the bottom boundary 16 of the retort being formed. The blasting holes are loaded with explosive up to an elevation corresponding to the top boundary 18 of the slot being formed. Such explosive is detonated in increments to explosively expand formation toward the free face provided by unfragmented formation surrounding the raise to enlarge the raise in steps progressing lengthwise along the slot being formed. Drilling and blasting sequences are repeated until the length of the slot is enlarged to the full width of the retort being formed. A more complete description of the techniques for forming the slot 22 are disclosed in U.S. Pat. Nos. 4,043,595 and 4,043,596.

Ultimately, the void space of the slot 22 becomes distributed as the void volume in the fragmented permeable mass of formation particles in the completed in situ retort. As used herein void volume and void fraction can be used interchangeably unless the context indicates otherwise. The horizontal cross-section area of the slot 22 has the same ratio to the horizontal cross section of the retort being formed as the desired void fraction in the fragmented mass. Thus, for example, if it is desired to have a void fraction of about 15 percent in a fragmented mass in the retort, the horizontal cross-sectional area of the slot 22 is 15 percent of the area within the side boundaries 14 of the retort being formed.

Following formation of the slot 22, blasting holes are drilled through the unfragmented formation 26 remaining within the retort site to the bottom boundary 16 of the retort being formed. The unfragmented formation 26 includes unfragmented formation 28 which corresponds with the stratum of higher kerogen content formation 20. An outer row of vertical blasting holes is drilled on each side of the slot to substantially coincide with the side boundaries 14 of the retort being formed. An additional row or rows of vertical blasting holes are drilled between the outer row and the large walls 24 of the slot. Explosive is loaded into such blasting holes and detonated to explosively expand the remaining portion of the formation 26 and 28 toward the free faces provided by the walls 24 of the unfragmented formation adjoining the slot 22.

This explosive expansion forms a fragmented permeable mass of formation particles 30 containing oil shale within the retort site as illustrated in FIG. 2. Such a fragmented permeable mass of formation particles 30 comprises an upper layer 34 consisting essentially of formation particles from the stratum of formation 28 containing a relatively higher kerogen content and a lower portion 32 containing formation particles having an average kerogen content lower than the average kerogen content of the particles in the upper layer 34. Drilling and blasting techniques used in forming the fragmented mass 30 are described in greater detail in U.S. patent application Ser. No. 790,350, entitled IN SITU OIL SHALE RETORT WITH A HORIZON- TAL SILL PILLAR, filed Apr. 25, 1977, now U.S. Pat. No. 4,118,071 issued on Oct. 3, 1978, by Ned M. Hutchins. That application is assigned to the same assignee as the present invention and is incorporated herein by this reference. Techniques for forming the fragmented mass 30 are also described in the above mentioned U.S. Pat. Nos. 4,043,595; 4,043,596; 4,043,597 and 4,043,598.

The explosive expansion step distributes the void volume of the slot 22 into the interstices between particles in the mass of fragmented formation particles remaining after explosive expansion. Formation is explosively expanded into the adjacent void primarily due to the influence of the explosives, as the entire blasting sequence occurs in such a short time interval that gravity has a relatively minor influence. Due to this explosive expansion, the movement of the fragmented formation particles is almost exclusively inwardly toward the slot. Thus, the upper layer 34 contains essentially only formation particles from the stratum 28 of oil shale having a higher average kerogen content.

Thus, the explosive expansion step produces a fragmented permeable mass of formation particles 30 containing oil shale in an in situ retort, in which an upper layer 34 of such fragmented mass has a relatively high kerogen content and in which a lower portion 32 of such fragmented mass has a relatively lower kerogen content than the upper layer. For example, the fragmented mass 30 can have an average kerogen content such as about 17 gallons per ton. The upper layer 34 of such fragmented mass can have a relatively higher kerogen content such as over 30 gallons per ton.

The upper layer 34 of the fragmented mass 30 forms an ignition situs for the retorting process to be conducted through the fragmented mass. The formation particles within the upper layer 34 of the fragmented mass have a lower ash content per unit volume than the average ash content per unit volume of the oil shale particles in the fragmented mass and have a higher heat of combustion than the average heat of combustion of the oil shale particles in the fragmented mass. The term "heat of combustion" as used herein refers to the amount of heat evolved by a unit weight of oil shale, including noncombustible constituents of oil shale, and is not limited to just the kerogen contained in such oil shale.

For an ignition situs to be of value in establishing a combustion zone, it is preferred that the formation particles within such an ignition situs have a higher heat of combustion than the average heat of combustion of oil shale in the fragmented mass. Such characteristics are provided by forming an upper layer 34 of the fragmented mass in a stratum of formation having a higher kerogen content than the average kerogen content of formation forming the fragmented mass. The particles within such an ignition situs have a lower ash content per unit volume than the average ash content per unit volume of oil shale in the fragmented mass.

The upper layer 34 extends across substantially the entire retort site. Such a layer of high kerogen content oil shale particles within a stratum across the top of the fragmented permeable mass facilitates the creation of an even combustion zone extending across the top of the fragmented mass. Preferably the entire top layer of the fragmented permeable mass contains formation particles having a relatively higher average kerogen content than the average kerogen content of the formation particles within the fragmented mass.

A combustion zone can be established in the fragmented mass 30 by a variety of techniques such as techniques described in the aforementioned U.S. Pat. No. 3,952,801. To establish the combustion zone, air or other oxygen-containing gas can be introduced to an ignition situs in the upper layer 34 at the top of the fragmented mass 30 through a conduit or bore hole 36. Simultaneously, a combustible fuel, such as shale oil or LPG, is introduced to the ignition situs in the upper layer 34 through the bore hole. The fuel and air mixture at the ignition situs can be ignited by means such as an electrical spark or flare, and the resulting flame is used to heat the fragmented permeable mass of formation particles within the upper layer of the fragmented mass to the ignition temperature of oil shale contained therein. Once ignition is started, the flow of combustible fuel can be turned off. Air or other oxygen-containing gas is introduced through the conduit to propagate the combustion zone laterally and downwardly through the fragmented permeable mass. The oxygen-containing gas can contain steam, recycled off gas, other inert diluents or limited quantities of fuel for maintaining a secondary combustion zone.

If desired, the rate of introduction of an oxygen-containing gas into the retort can be reduced such that substantially no heat is transferred by gas flow from the combustion zone, as described in application Ser. No. 839,010, filed on Oct. 3, 1977, entitled METHOD FOR ASSURING UNIFORM COMBUSTION IN AN IN SITU OIL SHALE RETORT, now abandoned, assigned to the same assignee as the present application and incorporated herein by this reference. Decreasing the rate of gas flow permits lateral heat transfer without significant downward advancement of the combustion zone. This can be effected by temporarily completely shutting off the flow of oxygen-containing gas into the retort. Using this technique, the combustion zone can thereby extend laterally to the side walls 14 of the retort without appreciable downward movement. The rate of lateral propagation of the combustion zone can be increased and the rate of downward propagation of the combustion zone can be reduced by introducing a small amount of an oxygen-containing gas, such as air, to the bottom of the retort. Such gas can be introduced into the retort through the access drift 40. Such introduced gas passes upwardly through the retort 30 into the combustion zone. Gas can be withdrawn from the retort through the conduit 36 used for introducing air downwardly into the retort when igniting the upper layer of the fragmented mass.

After the combustion zone has spread across the upper layer of the fragmented mass to the side boundaries of the retort being formed, introduction of an oxygen-containing gas, such as air, as a gaseous combustion zone feed into the top of the in situ oil shale retort can be restarted. By introduction of a combustion zone feed into the top of the retort, the combustion zone is advanced downwardly through the retort thereby retorting oil shale in a retorting zone on the advancing side of the combustion zone. An off gas containing combustion gas generated in the combustion zone, gaseous products produced in the retorting zone, gas from carbonate decomposition, and any gaseous portion of the combustion zone feed introduced to the top of the retort that does not take part in the combustion process is withdrawn from the retort through the access drift 40.

The method of this invention has significant advantages compared to prior art methods for establishing a combustion zone in a retort. For example, it is estimated that when the upper layer of the fragmented mass has a Fischer assay of only about nine gallons per ton it can take up to about twenty-four hours of heating to ignite oil shale particles in such an upper layer. When the upper layer of the fragmented mass has a Fischer assay of more than about 25 gallons per ton, it can take as little as three hours of heating to establish a combustion zone across the entire lateral extent of the fragmented mass within the in situ oil shale retort. Substantial savings in fuel, therefore, result from having the upper layer of the fragmented mass forming an ignition situs containing oil shale particles having a relatively high kerogen content. With such a quick start-up time, usable products can be obtained from the retort faster than with prior art methods. In addition, because of the quick start-up, less energy is expended for driving blowers and for introducing combustible fuel and air into the retort during the nonproductive start-up operation.

Another advantage of the method is that a combustion zone extending across the entire lateral extent of the retort can be established, thereby avoiding bypassing pockets of oil shale in the upper edges of corners of the retort. This results in enhanced yield of products from the fragmented permeable mass in the retort, and production of products from retorting oil shale in the walls of unfragmented formation at the corners of the retort.

There is a greater tendency for a combustion zone to propagate through an upper layer having a high heat of combustion than through oil shale having low heat of combustion. Providing an ignition situs with higher than average kerogen content helps promote lateral propagation of the combustion zone across the fragmented mass adjacent the top boundary. The combustion zone tends to spread along such an upper layer a greater extent relative to downward propagation than it would in a fragmented mass having substantially uniform kerogen content near the top boundary.

The upper layer 34 of the fragmented mass 30 should have a Fischer assay of at least about 25 gallons per ton. If the upper layer has a Fischer assay of less than 25 gallons per tone, no significant advantage is gained by forming the upper layer in such a stratum of oil shale. Preferably the upper layer of the fragmented mass is formed in a stratum of oil shale which after explosive expansion contains oil shale particles having a Fischer assay substantially greater than 25 gallons per ton. Such oil shale particles having a Fischer assay of greater than 25 gallons per ton ignite readily and burn uniformly. Fewer burners and ignition sites are required to insure that a combustion zone propagates laterally to the side boundaries of the retort because such oil shale in the upper layer is more easily ignited than the average oil shale in the fragmented mass. Thus, substantial savings in capital and operating costs for burners and substantial savings in costs incurred in providing bore holes and conduits for introduction of fuel and burners to the top of the fragmented permeable mass can be achieved.

Another advantage of this invention is that a combustion zone which is flat and uniformly transverse to its direction of advancement can be established in the retort. Thus, oxidation and excessive cracking of the products produced in the restoring zone which can occur with a skewed and/or warped combustion zone are avoided.

A further advantage is that consumption of fuel such as shale oil or liquefied petroleum gas is reduced. Rather than using a large amount of fuel, a lesser amount of fuel is required for igniting the upper layer of the fragmented mass when the upper layer has a high kerogen content.

Another advantage of this method is that it can be practiced in an in situ oil shale retort that is substantially filled with a fragmented mass, i.e., there is no requirement for any additional void space within the fragmented mass other than the void spaces in the interstices among the particles. Thus there is no need for a void at the top of the fragmented mass after explosive expansion of formation. Since no void space is required at the top of the fragmented mass, the fragmented mass of particles within the retort can support overlying formation. This allows a higher percentage of the formation to be fragmented with enhanced recovery of products because less formation needs to be left unfragmented as supporting pillars for overburden, than if the retort were only partially filled with a fragmented mass of formation particles. Another advantage of having a substantially filled retort is that sloughing of overburden into a void at the top of the fragmented permeable mass during ignition of the fragmented mass with resultant loss of support for the upper portion of the overburden does not occur. It is also easier to ignite a substantially filled retort than a partially filled retort. This is because sloughing of overburden onto the top of the fragmented mass during establishment of a combustion zone can decrease the temperature of oil shale already heated to above its ignition temperature to a temperature below the ignition temperature of the oil shale.

Advantages of the method herein disclosed are demonstrated by the following control and example.

CONTROL

A retort containing a fragmented permeable mass of formation particles containing oil shale is formed in the south/southwest portion of the Piceance Creek structural basin in Colorado. The retort is square in cross section having a horizontal cross-sectional area of about 1000 square feet. The retort is about 113 feet high. Oil shale at the top of the fragmented permeable mass has a Fischer assay from about 10 to about 15 gallons per ton. To establish a combustion zone at the top of the retort, 16 scfm (standard cubic feet per minute) of LPG, having a heating value of 2300 btu/scf (British thermal units per standard cubic foot) and sufficient oxygen to completely oxidize the LPG are introduced to the top of the retort and the LPG is ignited. Establishment of a combustion zone at the top of the retort requires about twenty-four hours.

EXAMPLE

A retort containing a fragmented permeable mass of formation particles containing oil shale is formed in the south/southwest portion of the Piceance Creek structural basin in Colorado. The retort is square in cross section having a horizontal cross-sectional area of about 1000 square feet. The retort is about 113 feet high. The fragmented permeable mass of formation particles consists of two fractions, an upper layer having higher than average kerogen content and a lower portion of fragmented particles of oil shale having a lower average kerogen content than the upper layer. The upper layer of the fragmented mass lies within a stratum of formation about 20 feet thick having a Fischer assay of about 25 gallons per ton and contains particles of such Fischer assay. The average Fischer assay for the entire fragmented permeable mass of formation particles is about 10 to 15 gallons per ton.

The upper layer of the fragmented mass is ignited by introducing liquefied petroleum gas into the upper layer and igniting such liquefied petroleum gas. The upper layer of the fragmented mass ignites forming a combustion zone across substantially the top of the fragmented permeable mass in about three hours.

Although this invention has been described in considerable detail with reference to certain versions thereof, other versions are within the scope of this invention. For example, for a retort having a substantial cross-sectional area, it can be preferable to have a plurality of ignition sites at the upper layer of the fragmented mass so ignition is obtained at several points across the top boundary and distance for lateral propagation of the combustion zone in the upper layer of the fragmented mass is minimized.

In addition, although FIGS. 1 and 2 show a retort where an in situ retort is formed by excavating a vertically extending void in the retort site and explosively expanding the remaining portion of formation in the retort site towards such a void, the technique is also suitable when a retort is formed by explosively expanding formation towards a horizontally extending void. Techniques for forming an in situ oil shale retort by explosive expansion towards such horizontal voids is described in U.S. Pat. Nos. 4,043,597 and 4,043,598, for example. In such a technique the top boundary of the retort can be formed adjacent a stratum of formation having an average kerogen content higher than the average kerogen content of formation in the retort site. Little vertical mixing occurs during explosive expansion towards such a horizontal void and forming the top boundary of an in situ retort adjacent such a stratum provides an upper layer having a high kerogen content.

Because of variations such as these, the spirit and scope of the appended claims should not necessarily be limited to the description of the preferred versions contained herein.

What is claimed is:

1. A method for recovering liquid and gaseous products from an in situ oil shale retort in a subterranean formation containing oil shale and having a plurality of strata of formation extending through a retort site, at least one stratum of formation having a higher average kerogen content than the average kerogen content of formation within the retort site, the in situ oil shale retort containing a fragmented permeable mass of formation particles containing oil shale and having top, bottom and side boundaries, the method comprising the steps of:

excavating at least one void within the retort site and leaving a remaining portion of unfragmented formation within the retort site with such a stratum of formation having a higher average kerogen content being adjacent the top boundary;

explosively expanding the remaining portion of unfragmented formation within the retort site toward such a void for forming a fragmented permeable mass of formation particles having an upper layer adjacent the top boundary containing fragmented particles substantially from such a stratum of formation having a higher average kerogen content and a lower portion containing fragmented particles having a lower average kerogen content than the upper layer;

igniting the fragmented formation particles in the upper layer of the fragmented mass for establishing a combustion zone in the fragmented mass;

introducing an oxygen containing gas to the fragmented mass for maintaining the combustion zone and advancing the combustion zone through the fragmented mass;

withdrawing an off gas from the fragmented mass whereby gas flow on the advancing side of the combustion zone establishes a retorting zone in the fragmented mass and advances the retorting zone through the fragmented mass thereby producing liquid and gaseous products, said gaseous products being withdrawn in the off gas; and withdrawing such liquid products from the lower portion of the fragmented mass.

2. A method as recited in claim 1 wherein the upper layer of the fragmented mass contains oil shale particles having a Fischer assay of at least about 25 gallons per ton.

3. A method as recited in claim 1 wherein the upper layer of the fragmented mass contains oil shale particles having a Fischer assay substantially greater than 25 gallons per ton.

4. A method for recovering liquid and gaseous products from an in situ oil shale retort in a subterranean formation containing oil shale and having a plurality of strata of formation extending through a retort site, at least one stratum of formation having a higher average heat of combustion than the average heat of combustion of the oil shale formation within the retort site, the in situ oil shale retort containing a fragmented permeable mass of formation particles containing oil shale and having top, bottom and side boundaries, the method comprising the steps of:

excavating at least one void within the retort site and leaving a remaining portion of unfragmented formation within the retort site with such a stratum of formation having a higher average heat of combustion being adjacent the top boundary;

explosively expanding the remaining portion of unfragmented formation within the retort site toward such a void for forming a fragmented permeable mass of formation particles having an upper layer adjacent the top boundary containing fragmented particles substantially from such a stratum of formation having a higher average heat of combustion and a lower portion containing fragmented particles having a lower average heat of combustion than the upper layer; igniting the fragmented formation particles in the upper layer of the fragmented mass for establishing a combustion zone in the fragmented mass;

introducing an oxygen containing gas to the fragmented mass for maintaining the combustion zone and advancing the combustion zone through the fragmented mass;

withdrawing an off gas from the fragmented mass whereby gas flow on the advancing side of the combustion zone establishes a retorting zone in the fragmented mass and advances the retorting zone through the fragmented mass thereby producing liquid and gaseous products, said gaseous products being withdrawn in the off gas; and withdrawing such liquid products from the lower portion of the fragmented mass.

5. A method as recited in claim 4 wherein the void excavated is at least one horizontally extending void.

6. A method as recited in claim 4 wherein the void excavated is at least one vertically extending void.

7. A method of forming a combustion zone within an in situ oil shale retort in a subterranean formation containing oil shale and having a plurality of strata of formation extending through a retort site, at least one stratum of formation having a higher average kerogen content than the average kerogen content of formation within the retort site, the method comprising the steps of:

excavating at least one vertically extending void within the retort site and leaving a remaining portion of unfragmented formation within the retort site, said vertically extending void extending through such a stratum of formation having a higher average kerogen content;

explosively expanding the remaining portion of unfragmented formation within the retort site, including such a stratum of formation having a higher average kerogen content toward such a vertically extending void for forming a fragmented permeable mass of formation particles having an upper layer containing fragmented formation particles substantially from said stratum of formation having a higher average kerogen content and a lower portion containing fragmented particles having a lower average kerogen content than the upper layer;

introducing a combustible fluid and an oxygen-containing gas to the upper layer of the fragmented mass;

igniting and burning the combustible fluid for supplying heat to the upper layer of the fragmented mass to raise the temperature of at least a portion of the upper layer to an ignition temperature of oil shale in the upper layer, thereby igniting the formation particles in the upper layer for establishing a combustion zone in the fragmented mass; and introducing an oxygen containing gas to the fragmented mass and withdrawing an off gas from the lower portion of the fragmented mass for maintaining the combustion zone and advancing the combustion zone downwardly through the fragmented mass.

8. A method as recited in claim 7 wherein the upper layer of the fragmented mass contains oil shale particles having a Fischer assay of at least about 25 gallons per ton.

9. A method as recited in claim 7 wherein the upper layer of the fragmented mass contains oil shale particles having a Fischer assay of substantially greater than 25 gallons per ton.

* * * * *